US011266186B2

(12) United States Patent
Marciano

(10) Patent No.: US 11,266,186 B2
(45) Date of Patent: Mar. 8, 2022

(54) ENHANCED GARMENT AND METHOD OF USING THE SAME

(71) Applicant: Ocean K. Marciano, Van Nuys, CA (US)

(72) Inventor: Ocean K. Marciano, Van Nuys, CA (US)

( * ) Notice: Subject to any disclaimer, the term of this patent is extended or adjusted under 35 U.S.C. 154(b) by 0 days.

(21) Appl. No.: 15/418,411

(22) Filed: Jan. 27, 2017

(65) Prior Publication Data

US 2018/0213865 A1 Aug. 2, 2018

(51) Int. Cl.

| | |
|---|---|
| ***A41D 13/00*** | (2006.01) |
| ***A41D 13/05*** | (2006.01) |
| ***A41D 13/08*** | (2006.01) |
| ***A41D 27/12*** | (2006.01) |

(52) U.S. Cl.

CPC ..... *A41D 13/0015* (2013.01); *A41D 27/12* (2013.01); *A41D 13/0512* (2013.01); *A41D 13/088* (2013.01); *A41D 2400/80* (2013.01)

(58) Field of Classification Search

CPC ..... A41B 1/08; A41B 7/00; A41D 19/01547; A41D 19/01552; A41D 19/01558; A41D 19/01564; A41D 2300/20; A41D 2400/80; A41D 27/12; A41D 2400/82

USPC ..... 2/59, 60, 115, 116, 125, 267, 467

See application file for complete search history.

(56) References Cited

U.S. PATENT DOCUMENTS 5,504,944 A * 4/1996 Bromer ..... A41D 19/01 2/125
5,715,539 A * 2/1998 Benecki ..... A41D 19/01564 2/160
5,784,720 A * 7/1998 Mellon ..... A41D 19/0041 2/123
6,212,687 B1 * 4/2001 Kwon ..... A41D 19/01547 2/161.3
7,191,470 B2 * 3/2007 Benini ..... A41D 13/0002 2/69
7,200,872 B2 * 4/2007 Gregory ..... A41D 13/08 2/162
7,383,591 B1 * 6/2008 Getzwiller ..... A41B 11/08 2/161.1

(Continued)

OTHER PUBLICATIONS

"Under Armour", Men's UA Combine® Training ColdGear® Long Sleeve T-Shirt, dated Sep. 13, 2015 via Wayback Machine, UnderArmour.com, viewed Jul. 20, 2018 <https://web.archive.org/web/20150913030209/https://www.underarmour.com/en-us/ct-cg-ls-tee/pcid1249052> (Year: 2015).*

(Continued)

*Primary Examiner* — Joshua E Rodden
(74) *Attorney, Agent, or Firm* — Omni Legal Group; Omid E. Khalifeh

(57) ABSTRACT

An enhanced garment and method of using the same is characterized by a garment that provides for one or more grip pads to be secured onto or integrated into the garment at locations where the grip pads may be advantageous to the user. In some embodiments, the positioning of the grip pads on or within the garment may correspond to locations wherein friction, cushioning, or other advantage is desired. When in use, the present invention may provide that the user may grip objects more securely, manipulate objects equipment more efficiently, or otherwise perform tasks in a desired way.

1 Claim, 4 Drawing Sheets

(56) References Cited

U.S. PATENT DOCUMENTS

| | | | | |
|---|---|---|---|---|
| 7,784,116 | B2 * | 8/2010 | Gallo | A41D 31/0044 2/267 |
| 2006/0053526 | A1 * | 3/2006 | Beland | A41D 13/0015 2/115 |
| 2008/0256091 | A1 * | 10/2008 | Kampmann | H04N 19/159 |
| 2008/0313793 | A1 * | 12/2008 | Skottheim | A41D 13/0153 2/461 |
| 2010/0229278 | A1 * | 9/2010 | Bates | A41D 13/0002 2/115 |
| 2012/0144544 | A1 * | 6/2012 | Telfer | A41D 19/0041 2/20 |
| 2014/0223630 | A1 * | 8/2014 | Johnson | A41D 19/01547 2/69 |
| 2017/0013888 | A1 * | 1/2017 | Webb | A41D 13/0015 |
| 2017/0239553 | A1 * | 8/2017 | Kowalsky | A41D 19/01558 |

OTHER PUBLICATIONS

"King", A7 Bar Grip Muscle Tee Shirt Review: Gnarly Bear Design, dated Oct. 11, 2016, Kingofthegym.com, viewed Jul. 20, 2018 <http://www.kingofthegym.com/a7-bar-grip-muscle-tee-shirt-review/> (Year: 2016).*

* cited by examiner

ENHANCED GARMENT AND METHOD OF USING THE SAME

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to garments and, more particularly, to an exercise garment with sewn-in grip pads suitable for both cushioning and providing grip to the user.

BACKGROUND

The benefits to the human body of regular exercise are well-documented. However, many persons find that their exercising is limited to some degree by their clothing, and thus they are unable to exercise to their full potential. In response to this situation, clothing companies have developed specialty garments intended to be used during exercise.

A variety of such specialty garments exist. Some specialty garments in existence employ certain fabrics that provide certain features, such as cooling to the user or durability and therefore value. Other specialty garments in existence employ certain design features, such as hoods, pockets, or padding to enhance one or more aspects of a user's experience.

Some other proposals for enhanced garments have been made. Examples include, for instance, U.S. Pat. No. 5,388,271 to Sessoms describing an insulated garment configured to protect and insulate the wearer in selected bodily areas; U.S. Pat. No. 6,532,599 B1 to Dugan describing shorts with removable pads; U.S. Patent Application Publication No. 2006/0272071 A1 associated with Mickle describing a shirt with extensive gripping members that resist the sliding of protective pads placed over the gripping members; U.S. Patent Application Publication No. 2011/0302687 A1 associated with Whaley describing a garment with integrated portions suitable for inducing drag or attaching water weights; and U.S. Patent Application Publication No. 2015/0297973 A1 associated with Beers describing garments possessing integrated dynamic padding systems.

Still, none of these in existence comprise beneficial characteristics described in the following disclosure. Thus, there remains a need for a garment that provides for enhanced grip and padding elements.

SUMMARY

The present disclosure is directed to enhanced garments that may provide for enhanced grip, cushion, or padding elements, in addition to other properties.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

The garment comprises a fabric assembly wherein certain grip or padding elements are sewn or otherwise integrated into a garment at certain locations that may be associated with athletic activities. It is contemplated that in certain embodiments the present invention may provide for an attractive garment adapted for use with a fitness activity, such as by way of illustration and not of limitation weight lifting, throwing, catching, or exercises involving gripping a pole.

It is also contemplated that the present invention may provide for one or more pads adapted to provide friction and therefore grip, padding and therefore cushion, or cooling, heating, or other such properties. It is contemplated that the term "pad," "grip pad," "cushion pad," or "grip and cushion pad" are herein used to describe solely the element being described, and are explicitly not used to limit the element to those properties only. For example, in certain embodiments the grip and cushion pad could provide grip and not cushion, or cushion and not grip. The grip pad could provide cushion but not grip, and the cushion pad could provide grip but not cushion. A grip pad could provide neither grip nor cushion, but rather a cooling, heating, or other such property. To the extent proper, the terms described above should be construed only to refer to the element being described, and not to any properties the element may or may not possess in any particular embodiment.

In some embodiments, the present invention may provide for a shirt that a user may wear. The present invention may also provide one or more grip pads on the garment at locations corresponding to a user's wrists. The present invention may also provide for an elastomeric band, sewn into the inner portions of terminal end of the present invention's sleeves, wherein the user may slip the elastomeric band over the user's fingers, thereby moving the sleeve towards the user's fingertips, thereby also sliding the grip pad into a position over a user's palm. The present invention may also provide for a thumbhole in one or more sleeves, wherein a user may insert the user's thumb through the thumbhole so as to further secure the present invention in place.

Therefore, in the embodiment described above, the sleeve portions of the present invention may be described as occupying two of many possible positions: an illustrative first position wherein the present invention's sleeve element covers the user to the user's wrist, thereby providing for the grip and cushion pad to be located over the user's wrist, and an illustrative second position wherein the user may pull an elastomeric band element over the user's fingers and insert the user's thumb through a thumbhole, thereby securing the grip pad over the user's palm.

In some embodiments, one or more grip pads may be located on the reverse of a shirt, centered to both a user's spinal column and to the midpoint between a user's shoulder blades. In such embodiments, it is contemplated that the grip pad may be adapted for use with, for purposes of illustration and not of limitation, a bar or barbell placed in such a location across a user's back.

In some embodiments, the present invention may comprise a total of three grip pads that may be incorporated within the present invention at locations on the garment corresponding to a user's wrists and in-between a user's shoulder blades. It is contemplated that any modifications to the grip pads discussed in the present disclosure, such as a grip pad's properties or the number of grip pads within a certain area, may apply to any embodiment of the present invention. By way of illustration and not of limitation, in some embodiments of the three-grip-pad embodiment discussed in this paragraph, it is contemplated that the grip pads may comprise one contiguous pad, or in other embodiments they may comprise several adjacent pads. Again for illustration and not limitation, in some embodiments of the three-grip-pad embodiment discussed in this paragraph, it is contemplated that one or more grip pads may provide for enhanced or friction as between the grip pad and another object or surface, whereas in other embodiments one or more grip pads may provide for reduced friction as between the grip pad and another object or surface.

It is contemplated that the present invention may be used in conjunction with various methods for exercise. By way of illustration and not of limitation, one or more embodiments of the present invention may provide that the present invention may be positioned in such a manner that the grip pads are located above a user's palms. In such a positioning, the present invention could be used to provide enhanced friction and stability for pull-ups, wherein the user may place the user's hands in position on a pull-up bar, and using the present invention's grip pads to provide enhanced stability to the user relative to the pull-up bar, perform pull-ups in a safe and efficient manner.

Another illustrative and non-limiting embodiment of a method of using the present invention could involve performing squats with a squat bar. In such an embodiment, the user could again position the present invention relative to the user's body to where the grip pads are positioned above the user's wrists. Using the center-mounted grip pad on the reverse of the garment, positioned to rest in-between the user's shoulder blades, the user could then grip the bar using the enhanced friction from the grip pads, and rest the bar across the user's back and resting on the center-mounted grip pad, thereby providing enhanced friction as between the bar and the user's shoulder or back area, thereby allowing a user to perform one or more squats in a safe and efficient manner.

In some embodiments, the present invention may provide for one contiguous grip pad, whereas in other embodiments two or more grip pads may be separated by a certain portion of fabric from each other.

In some embodiments, the grip pads may provide for a pocket element, wherein a heating or cooling pad may be inserted.

In some embodiments, the grip pad may provide for perforations or other adaptations that enhance airflow.

In some embodiments, the grip pad may be thicker with cushioning elements built into the grip pad.

In some embodiments, the grip pad may be thin and contain little to no cushioning elements.

In some embodiments, the grip pad may be configured in a circle, a square, a rectangle, an oval, or any other shape.

In some embodiments, the grip pad may extend from the portions of a shirt intended to cover a user's wrist to a user's forearm.

In some embodiments, the grip pad may extend from the portions of a shirt intended to cover a user's wrist to a user's shoulder or arm pit.

In some embodiments containing a grip pad located in-between a user's shoulder pads, it is contemplated that the grip pad may be rectangular, circular, oval, triangular, or any other shape.

In some embodiments containing a grip pad located in-between a user's shoulder pads, it is contemplated that the grip pad may stretch across the entire width of a user's shoulders, run vertically along a user's spine, or any combination thereof.

In some embodiments containing a grip pad located in-between a user's shoulder pads, it is contemplated that the grip pad may be configured to receive a heating or cooling pad.

In some embodiments containing a grip pad located in-between a user's shoulder pads, it is contemplated that the grip pad may provide for perforations or other adaptations that enhance airflow.

In some embodiments, the grip pad may glow in the dark using technology known in the art.

In some embodiments, the grip pad may provide for battery or solar powered illumination.

In some embodiments, the grip pad may be shaped in a way that is meaningful to the wearer, such as by way of illustration and not of limitation, in the shape of an initial, brand, or image. It is contemplated that in certain embodiments, the present invention may provide for a system, method and apparatus for use in capturing, implement, analyzing, or otherwise processing the data provided by the sensor.

In some embodiments, a grip pad may have a directional texture that provides friction to an object that contacts the grip pad while the object is traveling in a particular direction, but not provide friction if an object is traveling in a different direction when it makes contact with a grip pad.

In some embodiments, the surface of a grip pad may provide a smooth or otherwise reduced-friction surface.

In some embodiments, one or more grip pads may be between 1 mm and 51 mm thick.

In some embodiments, the grip pad may be constructed out of recycled or otherwise eco-friendly processes or materials.

In some embodiments, a grip pad may be lightweight, whereas in other embodiments it is contemplated that a grip pad may be weighted or otherwise denser than in other embodiments.

In some embodiments, a band element may be elastomeric and allow the user to loop the band over the user's fingers, thereby positioning the present invention further down the user's arm and also thereby positioning one or more grip pads over a user's palm(s), as described above.

In some embodiments, the band element may provide for a clasp, wherein a user may pull two ends of an elastomeric band element over the user's fingers, join the clasp, and use the present invention.

In some embodiments, the band element may comprise a band of fabric lacking stretch properties.

In some embodiments, the band element may have cutout elements within its width, such as by way of illustration and not of limitation, cutouts sufficient to spell out a brand name, symbol, or word in the cutout's negative space.

In some embodiments, the band element may glow in the dark, be reflective, or otherwise have luminescent properties.

In some embodiments, the band element may incorporate a magnetic element, such as by way of illustration and not limitation, a configuration wherein a magnetic element within the band may connect magnetically with one or more rings worn by the user. In such an embodiment, the user may pull up on the band, and the present invention may provide for a magnetic connection between the magnetic element within the present invention and the magnetic element within the ring, thereby creating a releasable attachment.

In some embodiments, the present invention may provide for other finger-holes within the sleeve element. By way of illustrative and non-limiting example, in addition to a thumbhole, the present invention may provide for holes for a user's other four fingers. In some embodiments, the present invention could provide for only a thumbhole and another hole suitable for sticking one's little or "pinky" finger through, or any combination of finger-holes.

In some embodiments, the present invention may take the shape of a long-sleeve shirt, a short-sleeve shirt, a tank top, a crop top, pair of pants, a pair of underwear or garment designed to be primarily worn under other clothing, tights, leggings, a hat or other head hear, one or more gloves, a glove and sleeve combination, a scarf, a jacket, a hoodie, a sweatshirt, a pair of shorts, a sports bra, a headband, a sweatband, one or more socks, an athletic cup, a compression shirt, an individual or "stand-alone" sleeve, shoulder pads, a brace for a joint such as an elbow or a knee, a bandage for a part of a user's body, a rain coat, a cape, tights or pair of pants, a wetsuit, a rash guard, or any other such article of clothing or garment for which the present invention might be suitable. The example used from time to time herein of a long-sleeve shirt is by way of illustration and not of limitation.

One or more of the above-disclosed embodiments, in addition to certain alternatives, are provided in further detail below with reference to the attached figures. The disclosed subject matter is not, however, limited to any particular embodiment disclosed.

Figure 1:
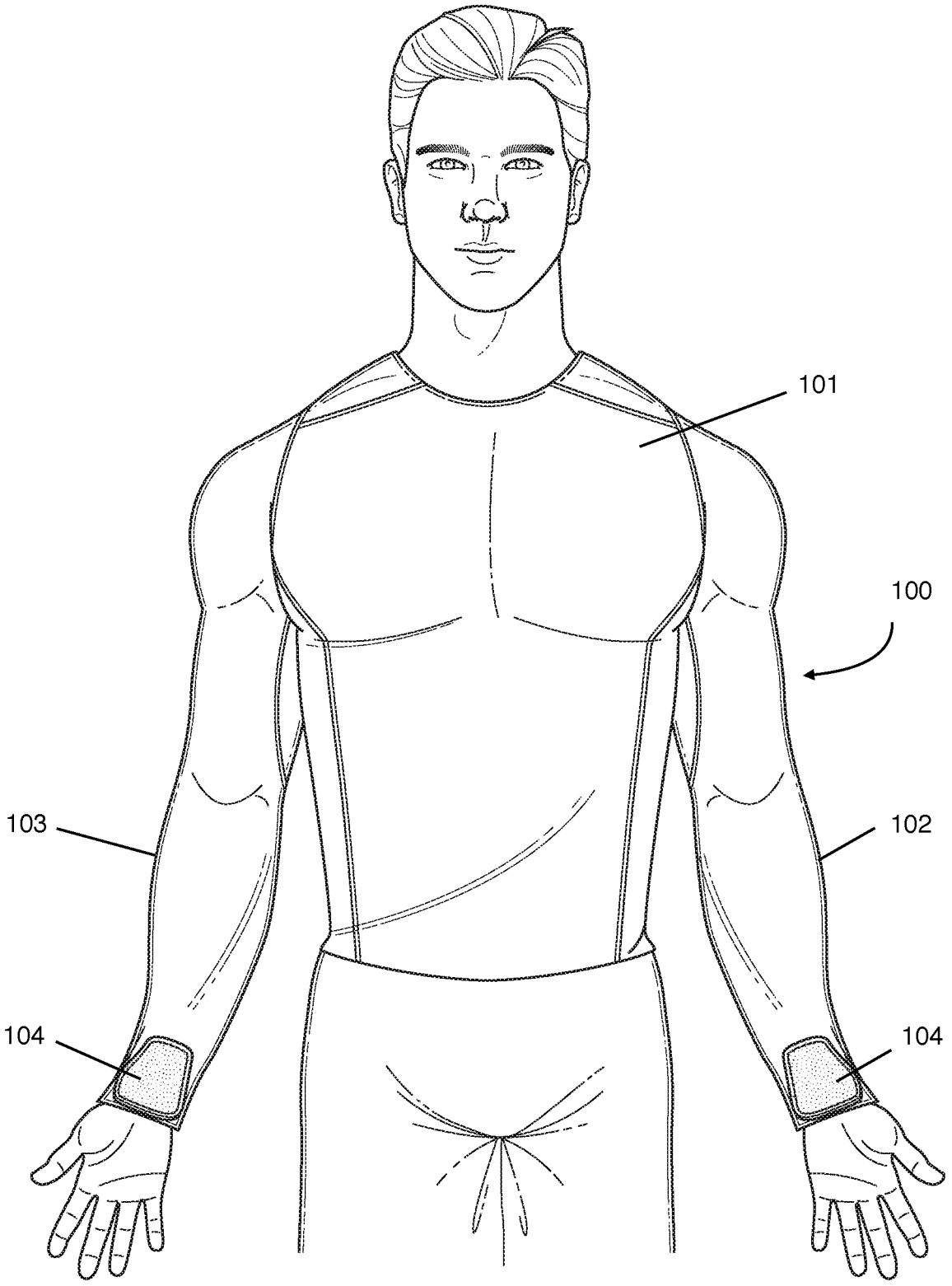
FIG. 1 shows a front planar view of a garment in accordance with one embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1, an embodiment of the present invention may comprise a garment 100, having a torso portion 101 and sleeve portions 102 and 103. Sleeve portions 102 and 103 may provide for a grip pad 104. Here, the grip pad 104 is sized and shaped as an approximation of the size and shape of an exemplary user's palms. Indeed, it may be seen that the grip pad 104 appears to define at least a majority of the surface area defined by the exemplary user's palms drawn by way of example and not limitation.

It is contemplated that the present invention may allow a user to position sleeve portions 102 or 103, or both, in either of a "first" or a "second" position. FIG. 1 depicts a "first" position, wherein sleeves 102 and 103 cover a user's wrists but not hands or palms. In such a position, grip pads 104 are positioned above a user's wrists. A user could also pull sleeve 102 or 103, or both, to a "second" position where sleeve 102 or 103, or both, cover(s) a user's hand(s) and palm(s). In such a position, it is contemplated that grip pad(s) 104 may be positioned over a user's palm(s). In a "second" position, it is contemplated that grip pads 104 may enhance a user's ability to grip objects in a user's palm via the grip pad's properties.

Continuing with FIG. 1, it is contemplated that in certain embodiments the present invention may provide for grip pad(s) 104 in an array of shapes and sizes. By way of illustration and not of limitation, in some embodiments grip pad(s) 104 may be rectangular, or circular, triangular, oval, or any other suitable shape. Grip pad(s) 104 may also be in the shape of a letter, number, or design. It is contemplated that in certain embodiments, the shape of one or more grip pad(s) 104 may correlate to one of many possible uses. Again for illustration and not limitation, a grip pad 104 in a circular shape could assist a user in manipulating circular objects, a grip pad 104 in a square shape could assist a user in manipulating square objects, and so forth. Additionally, a grip pad 104 in a rectangular shape could, in some configurations, assist a user in gripping a bar.

It is further contemplated that in certain embodiments, the fabric of garment 100 may comprise a lightweight, breathable material suitable for releasing heat, such as may be appropriate when exercising in a warm or hot environment. It is further contemplated that in some embodiments, garment 100 comprises a thick fabric suitable for trapping heat, such as may be appropriate when exercising in a cool or cold environment. In some embodiments, garment 100 may be comprised of a mixture of fabrics possessing varying properties. Moreover, in some embodiments, garment 100 may be comprised of neoprene or another material suitable for a wetsuit. Furthermore, in some embodiments, garment 100 may be comprised of a weighted material suitable for resistance training.

Continuing with FIG. 1, it is contemplated that in certain embodiments grip pad(s) 104 may be fixedly attached to garment 100 via adhesive or stitching elements. It is further contemplated that in some embodiments grip pad(s) 104 may be removably attached to sleeve(s) 102 or 103, or both, via a hook and loop fastener or a removable adhesive element, or may be removably secured by a pocket or other holding element within sleeve(s) 102 or 103, or both. It is further contemplated that in certain embodiments, the present invention may provide for one or more grip pad(s) removeably attached to garment 100, sleeve(s) 102 or 103, or both, and may also provide for one or more grip pad(s) fixedly attached to garment 100, sleeve(s) 102 or 103, or both.

Remaining with FIG. 1, it is contemplated that in certain embodiments sleeves 102 and 103 may be removably attached to torso portion 101 via a hook and loop fastener or other removable element. In some embodiments it is further contemplated that the present invention may provide for a stand-alone embodiment wherein sleeve(s) 102 or 103, or both, are provided without torso portion 101. It is to be understood that such stand-alone embodiments are not limited to sleeve(s) 102 or 103, or both, but would be appropriate for a stand-alone version of torso portion 101 having a centered grip pad 201, or any other suitable embodiment of the present invention.

With further respect to FIG. 1, in certain embodiments grip pad(s) 104 may provide for gel elements, or may be entirely comprised of a gel-pad as that element is known in the art. Some related embodiments may provide for an interchangeable system of gel and solid grip pad(s) 104 that may be of varying thicknesses and may possess varying properties such as by way of illustration and not of limitation, cushioning, friction, heating, cooling, luminescent, design, or other such properties.

Figure 2:
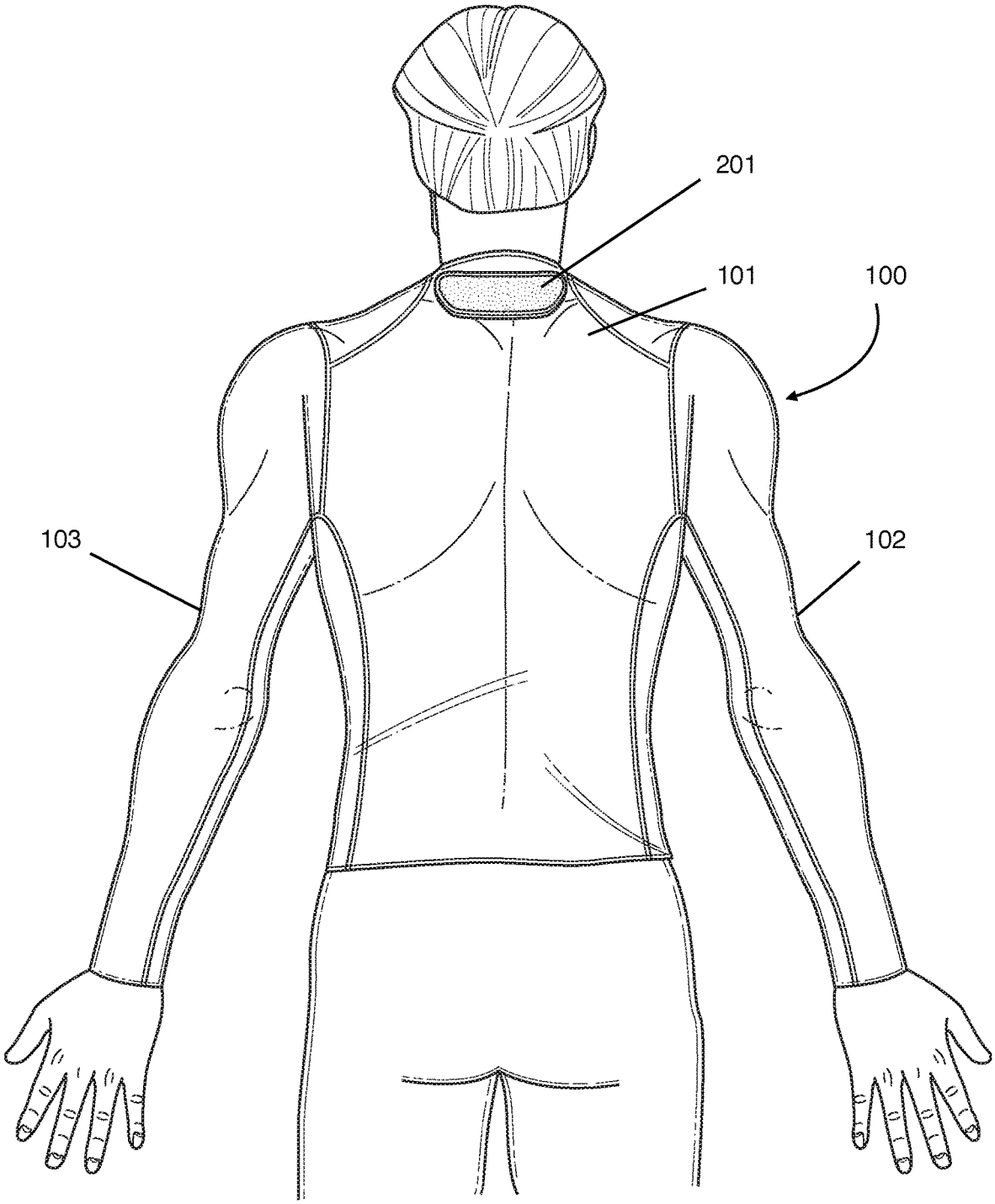
FIG. 2 shows a reverse or backside planar view of a garment in accordance with one embodiment of the invention.

With reference to FIG. 2, an embodiment of the present invention may comprise a garment 100, having a torso portion 101 and sleeve portions 102 and 103. Sleeve portions 102 and 103 may provide for a centered grip pad 201. The shape of centered grip pad 201 is drawn by way of example and not limitation. It is contemplated that centered grip pad 201 may provide a user with enhanced stability or cushioning relative to objects placed on centered grip pad 201.

Figure 3:
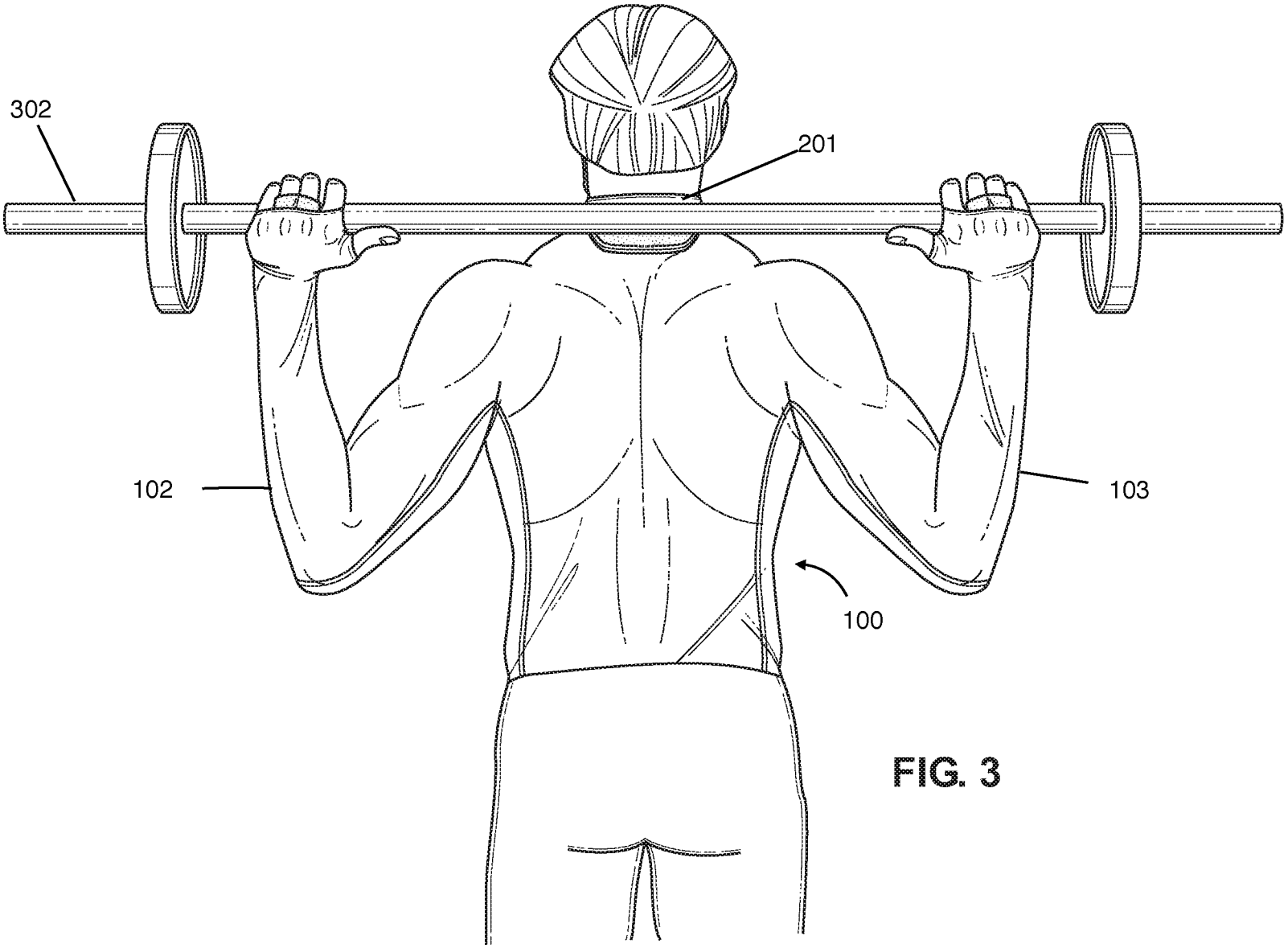
FIG. 3 illustrates an exemplary method that may be used in accordance with one embodiment of the invention.

With reference to FIG. 3, a method of using the present invention is illustrated. In some embodiments, a user may rest and secure a barbell 302 against centered grip pad 201. Once secured in place, a user may perform one or more exercises using barbell 302.

Continuing with FIG. 3, once a user has rested a barbell across a user's shoulders and across centered grip pad 201, and gripped the barbell securely using grip pads 104, a user may, for purposes of illustration and not limitation, squat down and then stand again, thereby using the weight of the barbell and any attached weight as resistance for a user's workout. It is contemplated that the properties of grip pads 104 and centered grip pad 201 may provide the user with enhanced stability and safety during such a workout.

Figure 4:
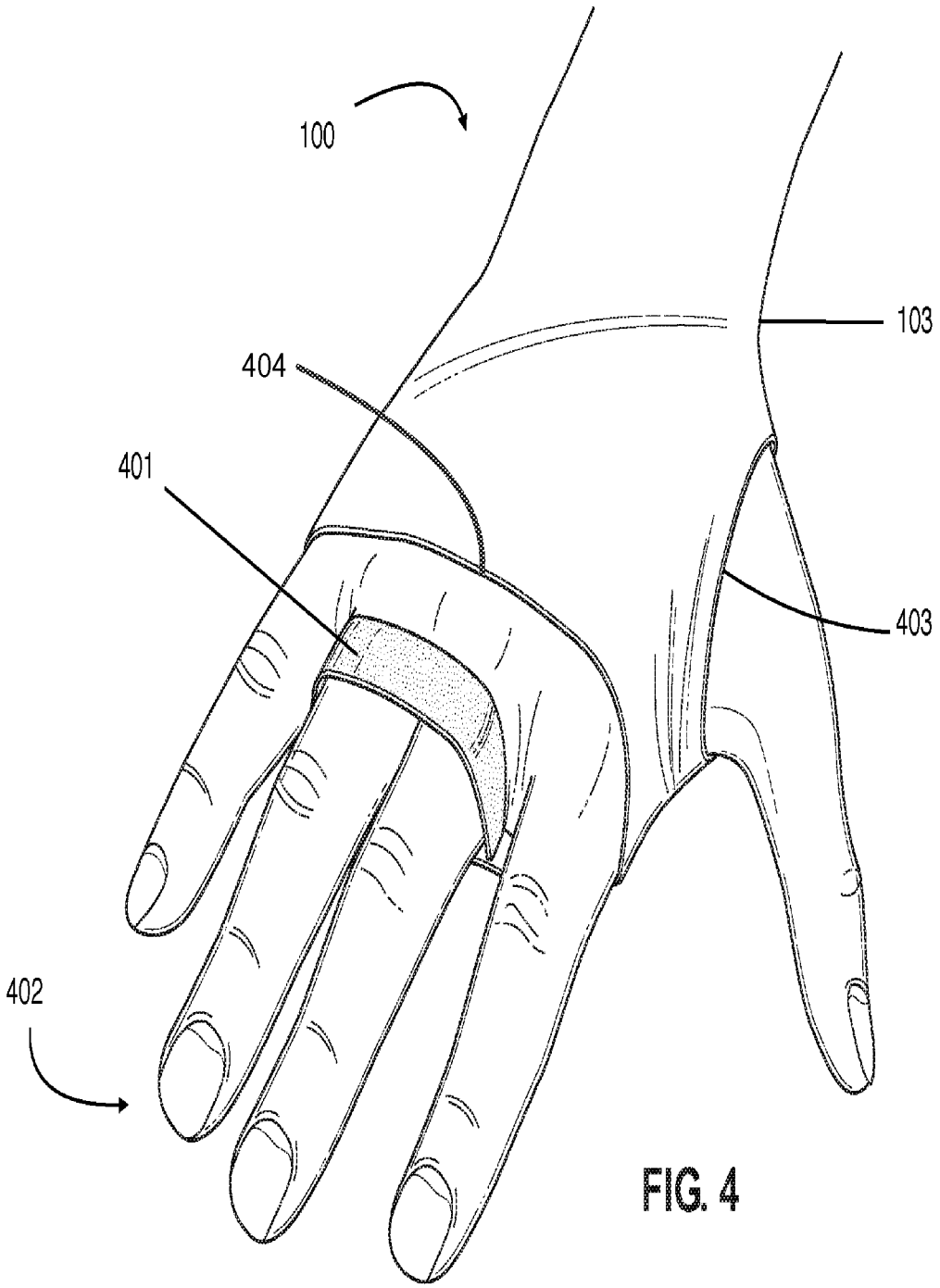
FIG. 4 is a front-perspective view of an embodiment of the present invention.

With reference to FIG. 4, an embodiment of the present invention may comprise a garment 100, having a sleeve portion 103 and thumbhole 403. Sleeve portion 103 is here shown with an elastomeric band member 401, which is intended to slip over a user's fingers 402, thereby moving sleeve portion 103 further towards a user's fingers 402. In addition, a user may slip the user's thumb through the thumbhole 403 as shown in FIG. 4. In such an embodiment, it is contemplated that grip pad 104 would be positioned over a user's palms.

Continuing with FIG. 4, it is contemplated that in certain embodiments, sleeve 103 may be detached from torso portion 101 (not shown). In some embodiments, sleeve 103 may be so short as to effectively comprise a forearm-sleeve element that provides for one or more grip pad(s) 104. In some embodiments, sleeve terminus 404 may be configured to extend over a user's knuckles, beyond a user's fingers, or provide for finger-holes (not shown). In some embodiments, the present invention may comprise a glove that may provide for one or more grip pad(s) 104.

Remaining with FIG. 4, it is contemplated that in certain embodiments, for purposes of illustration and not of limitation, the present invention may provide for a shoulder, elbow, knee, wrist, or other shaped fabric as an alternate support element for one or more grip pad(s) 104, and such alternate embodiments may also provide for an elastomeric band member 401 in an alternate configuration, although such an element is not required in such alternate embodiments.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the garment and method of using the same with which that terminology is associated. In general, the terms used in the following claims should not be constructed to limit the garment and method of using the same to the specific embodiments disclosed in the specification unless the above description section explicitly define such terms. Accordingly, the actual scope encompasses not only the disclosed embodiments, but also all equivalent ways of practicing or implementing the disclosed garment and method of using the same. The above description of embodiments of the garment and method of using the same is not intended to be exhaustive or limited to the precise form disclosed above or to a particular field of usage.

While specific embodiments of, and examples for, the garment and method of using the same are described above for illustrative purposes, various equivalent modifications are possible for which those skilled in the relevant art will recognize.

While certain aspects of the garment and method of using the same are presented below in particular claim forms, various aspects of the garment and method of using the same are contemplated in any number of claim forms. Thus, the inventor reserves the right to add additional claims after filing the application to pursue such additional claim forms for other aspects of the garment and method of using the same.

What is claimed is:

1. A method of using a garment, including the steps of:

providing a garment suitable for exercise, wherein said garment contains a torso portion, a first sleeve and a second sleeve, each sleeve extendable over at least a portion of a user's hand and one of a plurality of cushioning grip pads formed as a single member located on each sleeve at a wrist portion and a portion corresponding to a user's upper back along a base of such user's neck, wherein each single member grip pad located on each wrist portion is configured to span a distal end of the wrist portion and taper therefrom towards each sleeve, and the single member grip pad centrally located at the user's upper back is configured as a horizontally elongated member crossing over the user's spinal column;

positioning a first flat elastomeric band over a user's middle and ring fingers, thereby extending the first sleeve along a user's arm so as to position a first grip of the one or more grip pads in alignment with a user's palm;

positioning a second flat elastomeric band over a user's middle and ring fingers, thereby extending the second sleeve along a user's arm so as to position a second grip of the one or more grip pads in alignment with a user's palm;

providing an exercise bar;

resting the exercise bar across a user's lower neck or upper back in alignment with the center of the user's upper back and the exercise bar;

gripping the bar with each hand using the grip pads; and performing an exercise.

* * * * *